US006669196B1

(12) United States Patent
Washko

(10) Patent No.: US 6,669,196 B1
(45) Date of Patent: Dec. 30, 2003

(54) PUBLIC HEALTH ORIENTED BOARD GAME SYSTEM

(76) Inventor: Rita Washko, 5309 Bayshore Blvd., Tampa, FL (US) 33611

( * ) Notice: Subject to any disclaimer, the term of this patent is extended or adjusted under 35 U.S.C. 154(b) by 0 days.

(21) Appl. No.: 10/162,820

(22) Filed: Jun. 6, 2002

(51) Int. Cl.[7] ..... A13F 3/00
(52) U.S. Cl. ..... 273/243; 273/236; 273/430
(58) Field of Search ..... 273/236, 243, 273/254, 176, 430, 431

(56) References Cited

U.S. PATENT DOCUMENTS

| | | | | | |
|---|---|---|---|---|---|
| 4,201,388 | A | * | 5/1980 | Cantelon | 273/251 |
| 4,484,748 | A | * | 11/1984 | Becze | 273/256 |
| 5,282,630 | A | * | 2/1994 | Dupuis, Jr. | 273/252 |
| 5,607,160 | A | * | 3/1997 | Stevens et al. | 273/249 |
| 5,645,279 | A | * | 7/1997 | Reutlinger | 273/249 |
| 6,267,375 | B1 | * | 7/2001 | Bernstein et al. | 273/242 |

* cited by examiner

*Primary Examiner*—Paul T. Sewell
*Assistant Examiner*—Vishu K Mendiratta
(74) *Attorney, Agent, or Firm*—Francine L. Hewes, Esq.; Shumaker, Loop & Kendrick, LLP

(57) ABSTRACT

A board game system comprising: (i) a game board having a plurality of squares to define a path of travel; (ii) a plurality of tokens representing each player's position on the path of travel around the game board; (iii) a plurality of playing cards, having questions, and a plurality of potential answers, one of which is correct, the playing cards adapted to be selected randomly by the players whereby a player answers a question correctly to move the token accordingly; (iv) a plurality of "Anti-Hazard" cards, awarded to a player who lands on a single designated game board square, which can be used by a player to avoid getting pulled into a plurality of Hazard Traps; (v) two dice, including a first die with a plurality of spots controlling the number of squares which can be advanced by a player when a player answers a question correctly, the second die having a plurality of drawings, controlling whether a player escapes from a plurality of Hazard Traps; and (vi) an Information Booklet having a plurality of board game rules and instructions, background information on health-related topics, and references for each individual question on a playing card.

8 Claims, 5 Drawing Sheets

PUBLIC HEALTH ORIENTED BOARD GAME SYSTEM

BACKGROUND OF THE INVENTION

1. Field of the Invention

The present invention relates to a public health oriented board game system and more particularly pertains to educating people and promoting awareness as to the nature of infectious diseases, traumatic injuries, chemical threats, and public health issues.

2. Description of the Prior Art

The public has access to medical news and public health announcements, as well as publications that focus on self-help and self-treatment, which tend to be unreliable or inaccurate. Much of the information results in consumer confusion, with minimal understanding of the specific topic. Once the information is broadcasted or published, consumers have little information on how to explore the issue further and educate themselves about a certain issue.

The nation's premier public health agency, The Centers for Disease Control and Prevention ("CDC"), strives to keep the public informed of various issues, events, and situations that can affect the health of individuals and the general public. One of the goals of the CDC is behavior change that is conducive to good health. To achieve this goal, an effective medium of communication must be utilized, which captures the individual's interest, and conveys useful information that can assist in health promotion. Some of the ways that CDC promotes good health include its many public announcements, its posting of health-related information on its website, and the publication of the agency's weekly report, the Morbidity and Mortality Weekly Report ("MMWR").

This board game system provides an entertaining method to promote behavior change that is conducive to good health. The game focuses on public health-related topics and is primarily based upon MMWR reports from the years 1982 through early 2002 and from public health information found on CDC's website. Health topics include communicable diseases, environmental health, behavior or life-style factors, and chronic, non-communicable diseases such as heart disease and asthma. Also included is information on the topic of bioterrorism.

The difficulty of the questions ranges from simplistic, and occasionally humorous, to complex. Many of the topics have been well-publicized in the media and should sound familiar to most players. Furthermore, the questions and medical concepts that appear on the question cards are phrased in such a manner that many adults who are not members of the medical profession would understand. In the event that players do not know the correct answer to a question, the choices listed should provide an easy way to eliminate implausible answers.

For additional background information or additional references on the topic at hand, an information booklet is included with the game. The booklet includes a few summary sentences on the question's topic and the specific MMWR article or CDC website location of additional, more in-depth information. Thus, this game provides a structured yet fun way to learn about public health issues.

The use of board games of known designs and configurations is known in the prior art. More specifically, board games of known designs and configurations previously devised and utilized for the purpose of educating people through concentrated methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,228,860 to "AIDS: THE EPIDEMIC BOARD GAME" discloses a method of playing a board game on the subject of Acquired Immune Deficiency Syndrome ("AIDS"). Also, U.S. Pat. No. 5,244,391 to "EDUCATIONAL BOARD GAME" discloses an educational board game for teaching the harmful effects of chemical substance abuse.

While these devices fulfill their respective, particular objectives and requirements, the aforementioned patents do not describe a public health oriented board game system that educates people and promotes awareness as to the nature of infectious diseases, traumatic injuries, chemical threats, and public health issues.

In this respect, a public health oriented board game system according to the present invention substantially departs from the conventional concepts and designs of the prior art, and in doing so provides an apparatus primarily developed for the purpose of educating people and promoting awareness as to the nature of infectious diseases, traumatic injuries, chemical threats, and public health issues.

Therefore, it can be appreciated that there exists a continuing need for a new and improved public health oriented board game system which can be used for educating people and promoting awareness as to the nature of infectious diseases, traumatic injuries, chemical threats, and public health issues. In this regard, the present invention substantially fulfills this need.

SUMMARY OF THE INVENTION

In view of the foregoing disadvantages inherent in the known types of board games of known designs and configurations now present in the prior art, the present invention provides an improved public health oriented board game system As such, the general purpose of the present invention, which will be described subsequently in greater detail, is to provide a new and improved public health oriented board game system and method which has all the advantages of the prior art and none of the disadvantages.

To attain this, the present invention essentially comprises a public health oriented board game for educating people and promoting awareness as to the nature of infectious diseases, traumatic injuries, chemical threats, and public health issues. This educational board game emphasizes medical hazards imposed by various infectious diseases and environmental exposures, and also includes information pertaining to the latest topics in bioterrorism.

Teens through adults will find the game informative, pertinent, interesting, and challenging. The game is designed to be played by two to six players. The objects of the game are: (1) to learn about common and some not so common health hazards including infectious diseases, environmental hazards, and chemical agents; (2) to learn about some agents that are considered to be potential weapons, the so-called agents of bioterrorism; (3) to be the first to finish the game by successfully answering questions, using various strategies, and of course, having some luck on your side; and most of all (4) to have fun.

The public health oriented board game system is comprised primarily of a game board, player tokens which are referred to as "Vectors," usually an animal or arthropod, that can transmit a disease or illness to humans, playing cards, each card having questions related to infectious diseases, traumatic injuries, chemical threats, and public health issues, "Anti-Hazard" cards, one rolling die, one "Anti-Hazard" die, and an Information Booklet that provides background information and references for the individual questions.

During the game, players randomly select playing cards and answer the questions presented on the cards in order to move their respective Vector along the game board path. The number of squares that a player advances depends upon whether or not the player answers the question correctly or incorrectly. An incorrect answer results in the player moving forward only one square. If the question is answered correctly, the player then rolls the numbered die to determine how many squares the player advances.

Over the course of the game, players may happen to land on the square which leads to one of the Hazard Traps on the board. If a player lands on one of these squares, the player has been exposed to the specific hazard and risks becoming ill from the hazard unless the player escapes from the Hazard Trap within a certain number of turns. If the player is unable to escape within a given number of turns, the player must move the player's Vector to the first square of the preceding Hazard Trap. If the player is unable to escape from the first Hazard Trap, then the player must move the player's Vector back to the "START" square.

In general, the number of squares within a Hazard Trap corresponds to the lethality of the hazard. Thus, more serious illnesses or consequences have more playing squares in the Hazard Trap. The game is ultimately won by the first player to successfully escape and/or avoid the Hazard Traps and land on the "FINISH" square.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved public health oriented board game system which has all of the advantages of the prior art board games of known designs and configurations and none of the disadvantages.

It is another object of the present invention to provide a new and improved public health oriented board game system which may be easily and efficiently manufactured and marketed.

It is further object of the present invention to provide a new and improved public health oriented board game system which is of durable and reliable construction.

An even further object of the present invention is to provide a new and improved public health oriented board game system which is susceptible of a low cost of manufacture with regard to both materials and labor, and which accordingly is then susceptible of low prices of sale to the consuming public, thereby making such a public health oriented board game system economically available to the buying public.

Even still another object of the present invention is to provide a new and improved public health oriented board game system for educating people and promoting awareness as to the nature of infectious diseases, traumatic injuries, chemical threats, and public health issues.

Lastly, it is an object of the present invention to provide a new and improved game board system, which includes a game board, playing cards, "Anti-Hazard" cards, a numbered die, an "Anti-Hazard" die, player tokens, and an Information Booklet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
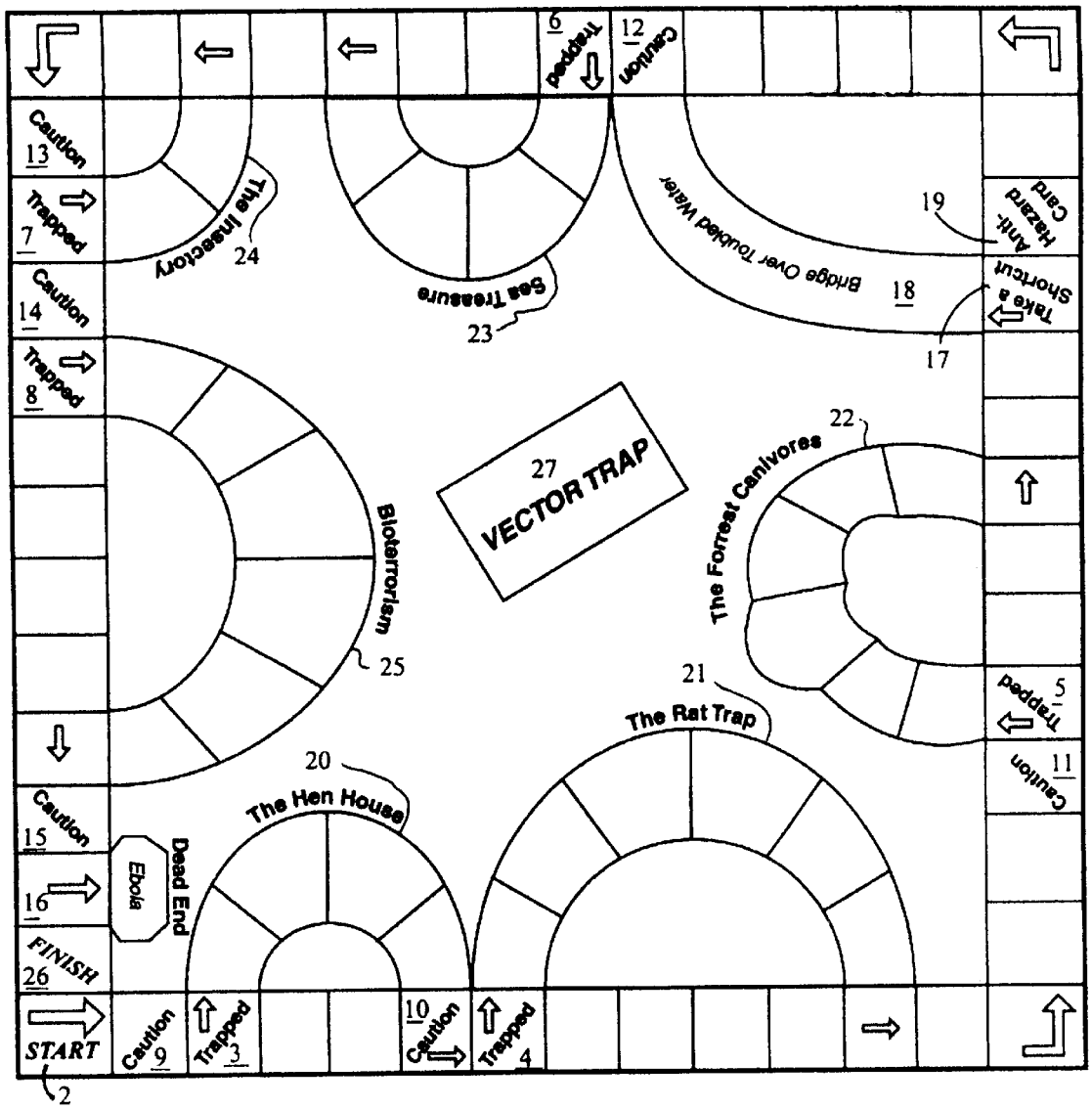
FIG. 1 is a top plan view of the foldable game board of the present invention.

With reference now to the drawings, and in particular to FIG. 1 thereof, the preferred embodiment of the new and improved public health oriented board game system embodying the principles and concepts of the present invention and generally designated by the reference numeral 1 will be described.

The present invention, the public health oriented board game system 1 is comprised of a plurality of components. Such components in their broadest context include a game board 1, playing cards FIGS. 3, 4, and 5, "Anti-Hazard" cards FIG. 6, a numbered die FIG. 7, an "Anti-Hazard" die FIG. 8, player tokens called "Vectors" FIGS. 2A, 2B, 2C, 2D, 2E and 2F, and an Information Booklet. Such components are individually configured and correlated with respect to each other so as to attain the desired objective.

Referring to FIG. 1, there is shown a game board 1 with a designated "START" square 2. Proceeding around the perimeter of the board in a counterclockwise direction are a number of designated squares labeled "Trapped," 3, 4, 5, 6, 7, 8, respectively. Other designated squares on the board "Caution" the player that the next square leads into a Hazard Trap 20, 21, 22, 23, 24, 25, squares 9, 10, 11, 12, 13, and 14, respectively. There is also a "Caution" square 15 immediately preceding the "Dead End, Ebola" 16.

One designated square, "Take a Shortcut" 17 allows the player to take a short-cut over "The Bridge Over Troubled Water" 18 and thus bypass seven playing squares. Another designated square "Anti-Hazard" card 19 provides the player with such card, which enables immediate escape from one of the six Hazard Traps 20, 21, 22, 23, 24, 25, respectively and is the only possible escape from the "Dead End, Ebola" 16.

There are six Hazard Traps 20, 21, 22, 23, 24, 25, including: "The Hen House" 20, "The Rat Trap" 21, "The Forest Carnivores" 22, "Sea Treasure" 23, "The Insectory" 24, and "Bioterrorism" 25.

Arrows are placed on the board to designate direction of advancement. Players advance in a forward direction with one exception—"The Insectory" Hazard Trap 24 moves the player in a reverse direction.

The last playing square of the game is the "FINISH" square 26. Within the center area of the board is a square 27, labeled "Vector Trap," where the question cards are placed, face-up on the board.

Figure 2A:
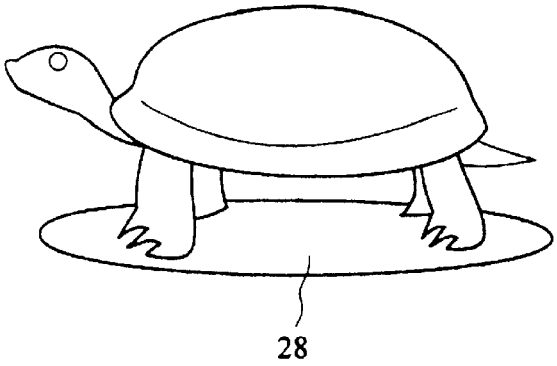
FIG. 2A is a side view of a playing piece, referred to as a "Vector," specifically a turtle.
Figure 2B:
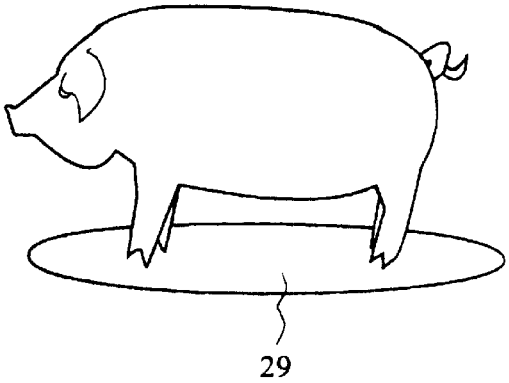
FIG. 2B is a side view of a playing piece, referred to as a "Vector," specifically a pig.

FIG. 2A shows one of six player tokens referred to as "Vectors," specifically, a turtle 28. FIG. 2B shows a pig 29.

Figure 2C:
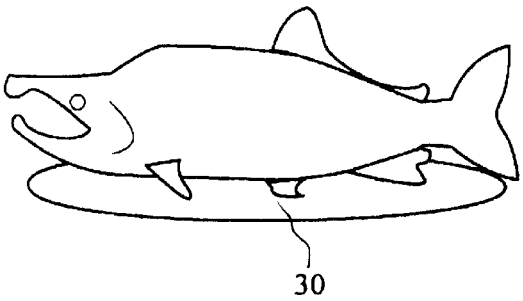
FIG. 2C is a side view of a playing piece, referred to as a "Vector," specifically a fish.
Figure 2D:
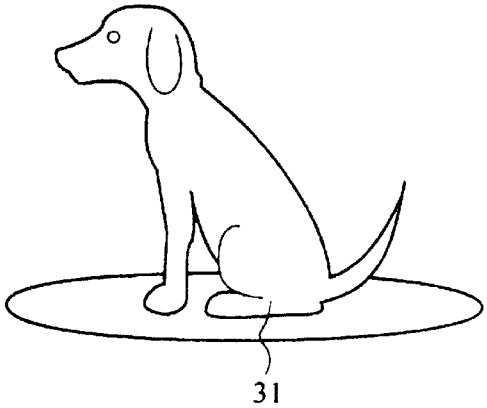
FIG. 2D is a side view of a playing piece, referred to as a "Vector," specifically a dog.
Figure 2E:
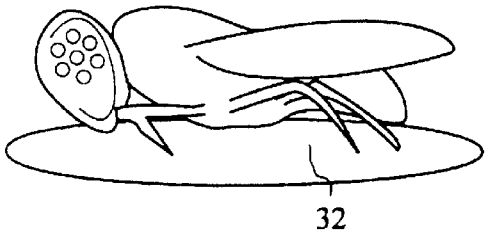
FIG. 2E is a side view of a playing piece, referred to as a "Vector," specifically a fly.
Figure 2F:
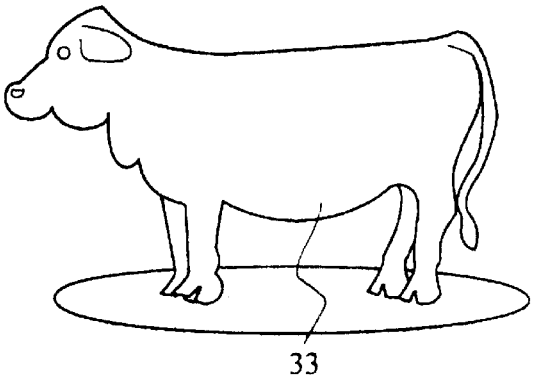
FIG. 2F is a side view of a playing piece referred to as a "Vector," specifically a cow.

FIG. 2C shows a fish 30. FIG. 2D shows a dog 31. FIG. 2E shows a fly 32. FIG. 2F shows a cow 33. All have a flat base which allows for movement around the board.

Figure 3:
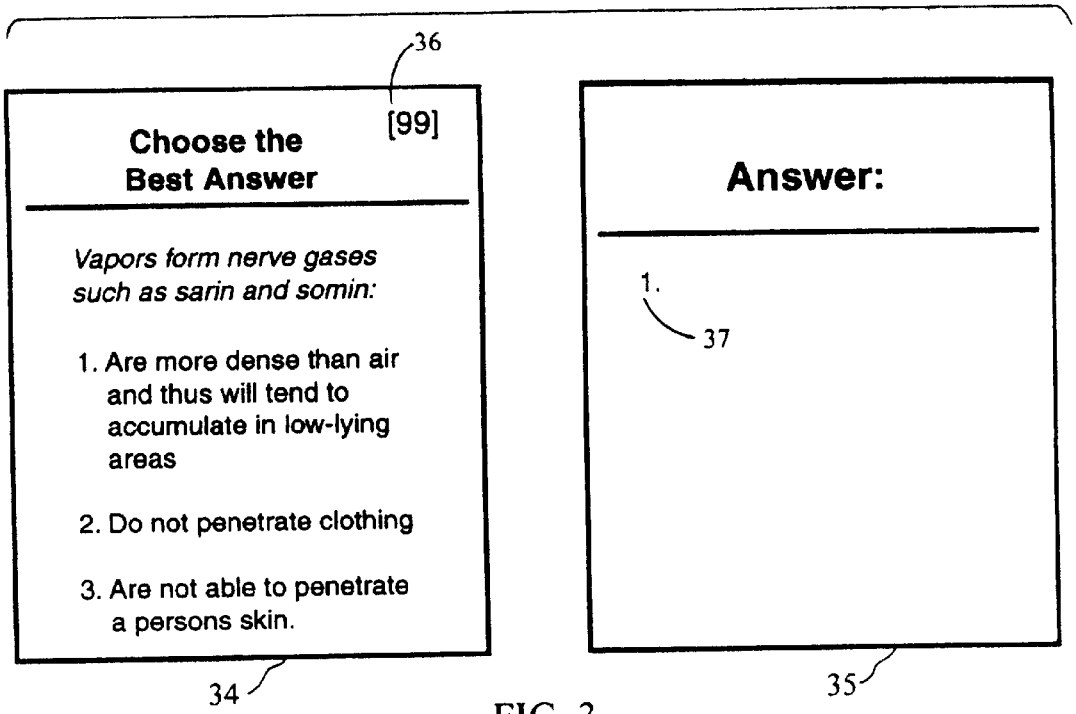
FIG. 3 represents the front and back side of a typical question card whose format starts with "Choose the Best Answer."
Figure 4:
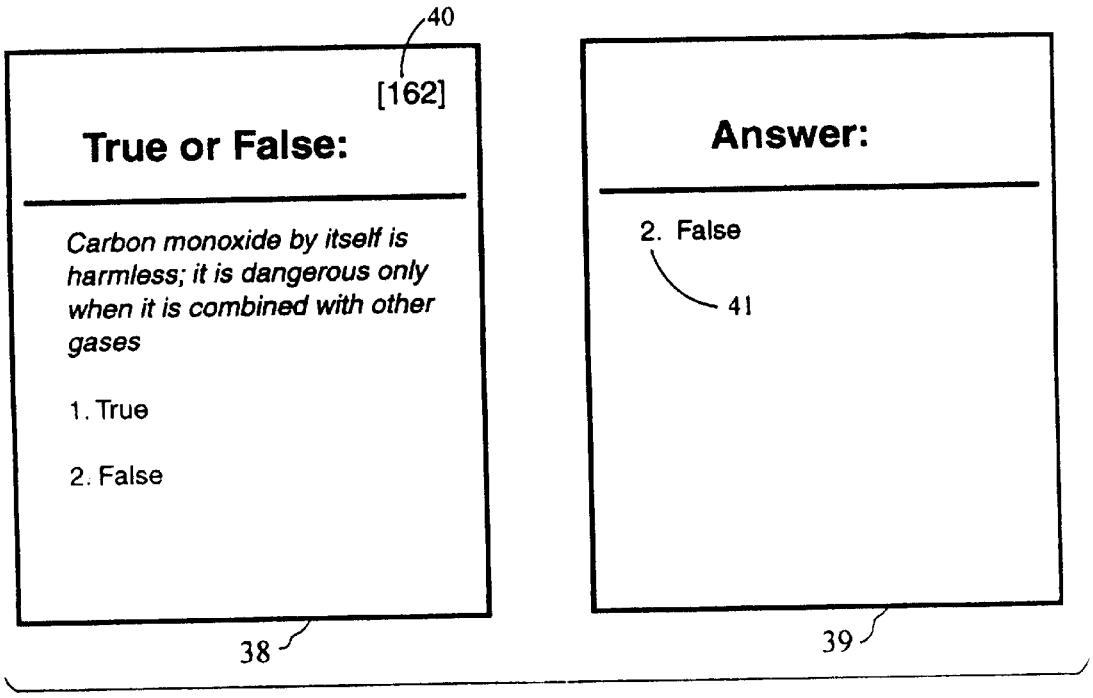
FIG. 4 represents the front and back side of a typical question card whose format starts with "True or False."
Figure 5:
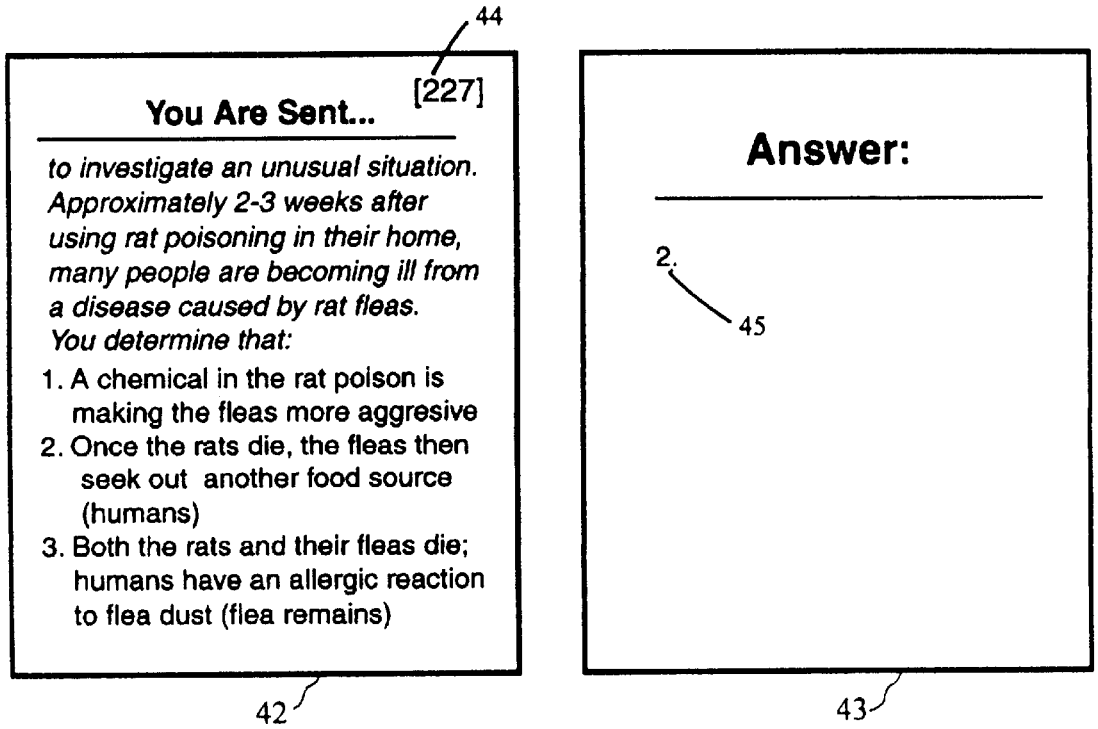
FIG. 5 represents the front and back side of a typical question card whose format starts with "You are Sent . . . "

The six hundred question cards have one of three formats, as shown in FIGS. 3–5. FIG. 3 shows the front 34 and back 35 of a typical question card whose format starts with "Choose the Best Answer." The upper right corner of the card has the question number 36 in brackets; this number can be cross-referenced in the Information Booklet where background information and references pertinent to the topic at hand are located. The answer to the question appears on the back 37 of the card.

FIG. 4 represents the front 38 and back 39 of a typical question card whose format starts with "True or False." The upper right corner of the card has the question number 40 in brackets; this number can be cross-referenced in the Information Booklet where background information and references pertinent to the topic at hand are located. The answer to the question appears on the back 41 of the card.

FIG. 5 represents the front 42 and back 43 of a typical Question card whose format starts with "You are Sent . . . " The significance of this format is that if the player answers this question correctly, the player advances two times the number rolled on the numbered playing die FIG. 7. Greater rewards in terms of squares advanced for answering these questions correctly are bestowed since these questions tend to be somewhat more difficult and involved than questions in the format as shown in FIGS. 3 and 4. The upper right corner of the card has the question number 44 in brackets; this number can be cross-referenced in the Information Booklet where background information and references pertinent to the topic at hand are located. The answer to the question appears on the back 45 of the card.

Figure 6:
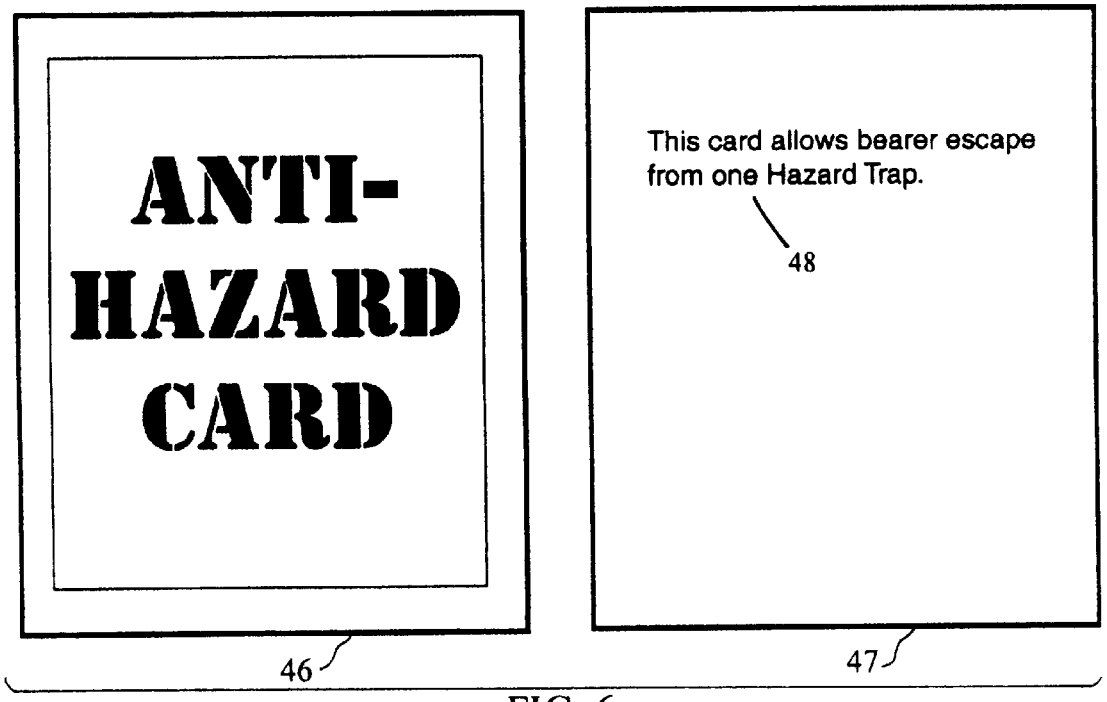
FIG. 6 represents the front and back side of an "Anti-Hazard" card.

FIG. 6 represents the front 46 and back 47 of an "Anti-Hazard" card. This card can only be obtained if the player lands on the "Anti-Hazard Card" square 19. The back 48 of the card states that "This card allows bearer escape from one Hazard Trap."

Figure 7:
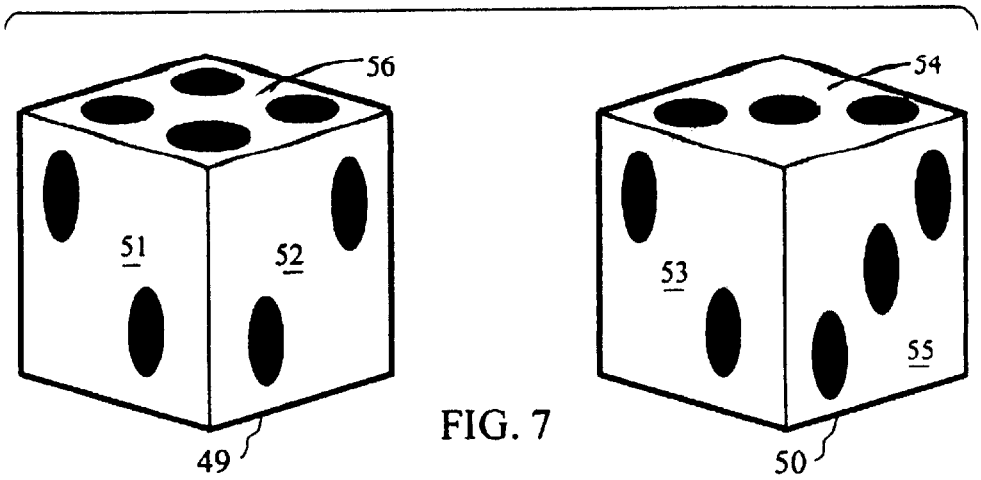
FIG. 7 is a view in perspective of the numbered playing die, demonstrating that three sides have two dots, denoting that the player advances two playing squares, two sides have three dots, and one side has four dots.

FIG. 7 shows all six sides 49, 50 of the playing die. The numbers on the die are weighted towards lower numbers, three sides 51, 52, 53 have two dots denoting that the player advances two playing squares, two sides 54, 55 have three dots, and one side 56 has four dots. The reason for this is that the players will advance around the board more slowly and thus be presented with more questions and information than would be allowed by using a conventional die that has one to six dots on its respective sides.

Figure 8:
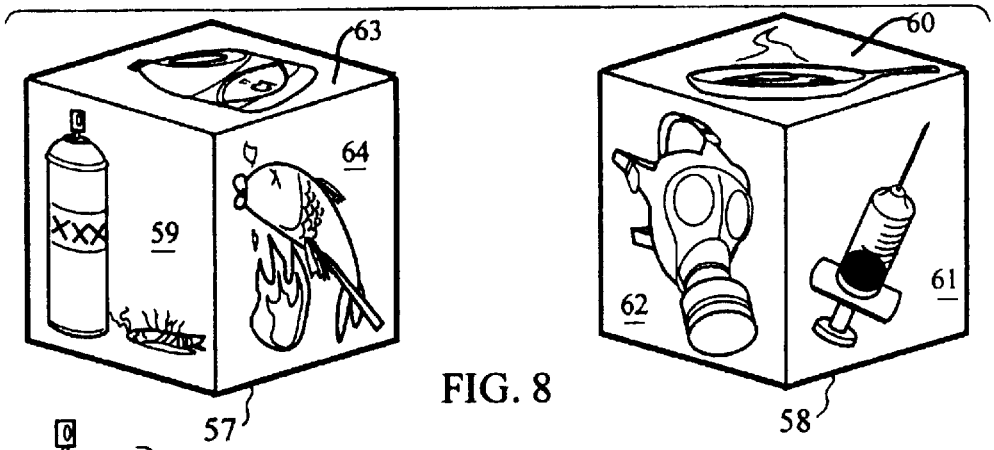
FIG. 8 is a view in perspective of the "Anti-Hazard" die.

FIG. 8 shows all six sides of the "Anti-Hazard" die 57, 58, used at the player's discretion, rather than the numbered die FIG. 7, and only if the player has been trapped in one of the six Hazard Traps on the playing board. The individual pictures FIGS. 9A, 9B, 9C, 9D, 9E and 9F represent: a can of insecticide or bug spay with a dead bug FIG. 9A to escape from "The Insectory" 24; a frying pan with a hard-cooked egg FIG. 9B, which represents cooking an egg until it is no longer runny, to escape from Salmonella in "The Hen House" 20; a syringe and needle FIG. 9C, which represents a rabies vaccine to escape from "The Forest Carnivores" 22; a gas mask FIG. 9D to escape from "Bioterrorism" 25; a chlorine bleach jug FIG. 9E since bleach kills Hantavirus, which is transmitted by rodent droppings and thus allows escape from "The Rat Trap"21; and raw fish over an open flame FIG. 9F, since cooking will kill some communicable diseases that are transmitted by fish and thus allows escape from "Sea Treasure" 23.

FIG. 10 shows excerpts of text from the Information Booklet, specifically those pertaining to the three question cards shown in FIGS. 3, 4, and 5; these are representative of the content in this Information Booklet 10. Players are informed that the first one hundred questions are based upon information contained in CDC's website 65 whereas the remaining five hundred questions are based upon the CDC's Morbidity and Mortality Weekly Reports 66. The numbers preceding these summaries 67, 68, and 69 correspond to the question card numbers 36, 40, and 44, respectively. All six hundred questions in this game have associated background material and references as shown in these examples from the Information Booklet FIG. 10.

The game board 1 is placed on a flat surface and the players sit around the board 1. Each player selects a "Vector" FIGS. 2A, 2B, 2C, 2D, 2E, 2F and places it on the "START" square 2. The question cards FIGS. 3, 4, and 5 are shuffled and then placed face up in the center of the game board 27. Given the large number of cards, a portion may have to be set aside initially and can be used to replenish the stack as the game progresses. Playing order is determined by each player randomly selecting a card from within the deck of question cards, not the top card; the player with the highest card number, shown in brackets in the upper right-hand corner of the card 36, 40, 44, goes first, the second-highest goes second, etc. "Anti-Hazard" cards FIG. 6 and the Information Booklet are set to the side.

The player selects the top question card when it is the player's turn and reads it out loud to the others. The player then selects one answer from the choices provided on the card. If the player answers correctly, as shown on the back of the card 37, 41, 45, the player then rolls the numbered die FIG. 7 and will move the player's Vector FIGS. 2A, 2B, 2C, 2D, 2E, 2F the same number of squares as that which rolls up on the die FIG. 7. If the answer is incorrect, the player's Vector FIGS. 2A, 2B, 2C, 2D, 2E, 2F is advanced only one square forward. Additional information and the specific reference is listed in numerical order in the Information Booklet. Once a question is read aloud and answered, a player may refer to the Information Booklet for the said reference or simply to read the background information on the player's question. Inside the Information Booklet typically are a few sentences of background information, mostly excerpts directly from the CDC's Morbidity and Mortality Weekly Reports. FIGS. 9, 67, 68, and 69 show the corresponding numbers from the question cards. If a player draws a question card that begins with "You Are Sent . . . " FIG. 5, the player moves the player's Vector FIGS. 2A, 2B, 2C, 2D, 2E, 2F two times the number rolled on the numbered die FIG. 7 if of course the player answers the question correctly. A wrong answer still enables a player to move forward only one square.

Players advance in a counterclockwise fashion. The square immediately preceding a Hazard Trap 20, 21, 22, 23, 24, 25 is labeled "Caution" 9, 10, 11, 12, 13, 14 to warn the player of the Hazard Trap 20, 21, 22, 23, 24, 25 ahead. If a player lands on a square that is the entrance 3, 4, 5, 6, 7, 8 to one of the six Hazard Traps 20, 21, 22, 23, 24, 25, the player is "Trapped" and must follow the squares through the Hazard Trap 20, 21, 22, 23, 24, 25 as the player plays out the player's turns. Keep in mind that a player must be out of the Hazard Trap 20, 21, 22, 23, 24, 25 by the end of the player's third turn. The entrance into the Hazard Trap 20, 21, 22, 23, 24, 25 does not count as a turn. By the third turn, the player must have moved onto the regular playing board path. A piece of scratch paper can be used to keep track of the number of turns a player has while in a Hazard Trap 20, 21, 22, 23, 24, 25. If the "Trapped" player is not out of the Hazard Trap 20, 21, 22, 23, 24, 25 by three turns, the player must then move the player's Vector FIGS. 2A, 2B, 2C, 2D, 2E, 2F to the playing square on the main board that is located at the end of the immediately preceding Hazard Trap 20, 21, 22, 23, 24, 25. If a player is "Trapped" in the first Hazard Trap, The Hen House 20, the player moves back to the square labeled "START" 2.

Once in a Hazard Trap 20, 21, 22, 23,.24, 25, the player has three options when it is the player's turn. This rule does not apply to "Dead End, Ebola" 16. First, a player can continue to play in the standard fashion by choosing a question card FIGS. 3, 4, 5 and attempting to answer it correctly. Second, a player can opt not to choose a question card and instead roll the "Anti-Hazard" die FIG. 8; the specific anti-hazard FIGS. 9A, 9B, 9C, 9D, 9E, 9F for the Hazard Trap 20, 21, 22, 23, 24, 25 must be rolled for the player to move back onto the regular playing board squares.

Figure 9A:
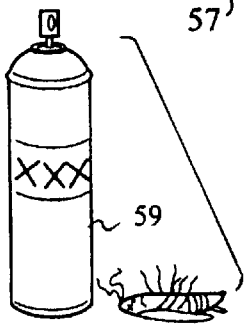
FIG. 9A is a detailed view of one of the faces on the "Anti-Hazard" die, namely a can of bug spray or insecticide with a dead bug.
Figure 9B:
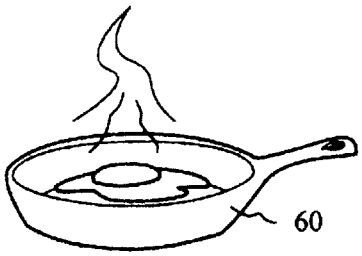
FIG. 9B is a detailed view of one of the faces on the "Anti-Hazard".die, namely a frying pan with a hard-cooked egg.
Figure 9C:
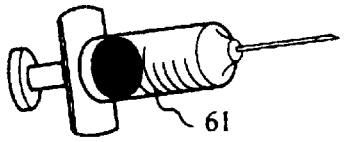
FIG. 9C is a detailed view of one of the faces on the "Anti-Hazard" die, namely a syringe and needle.
Figure 9D:
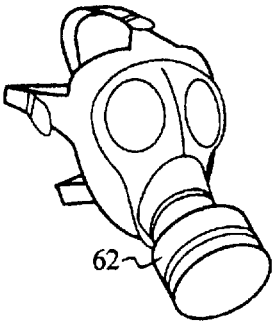
FIG. 9D is a detailed view of one of the faces on the "Anti-Hazard" die, namely a gas mask.
Figure 9E:
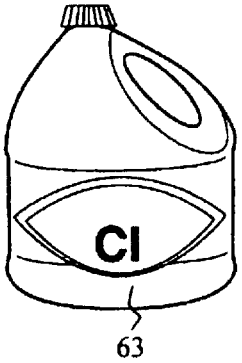
FIG. 9E is a detailed view of one of the faces on the "Anti-Hazard" die, namely chlorine bleach jug.
Figure 9F:
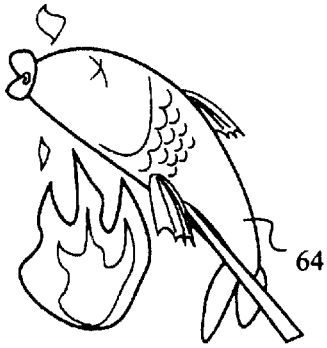
FIG. 9F is a detailed view of one of the faces on the "Anti-Hazard" die, namely a raw fish over an open flame The same reference numerals refer to the same parts throughout the various Figures.

The "Anti-Hazard" faces on the die FIGS. 9A, 9B, 9C, 9D, 9E, 9F are as follows: a can of insecticide or bug spray with dead bug FIG. 9A, which is the anti-Hazard for "The Insectory" 24; a trying pan with a hard-cooked egg FIG. 96, which is the anti-hazard for "The Hen House" 20 where Salmonella lurks; a syringe and needle FIG. 9C, which is the Anti-Hazard for "The Forest Carnivores" 22 where rabies lurks; a gas mask FIG. 9D, which is one of a number of protective devices worn to guard against contact with certain agents used for the purpose of "Bioterrorism" 25; a chlorine bleach jug FIG. 9E, which is the anti-hazard for The Rat Trap 21 where Hantavirus lurks; and raw fish over an open flame FIG. 9F, which is the Anti-Hazard for "Sea Treasure" 23 where various infectious diseases lurk.

The third option that a player has if caught in a Hazard Trap 20, 21, 22, 23, 24, 25 is to surrender the player's "Anti-Hazard" card FIG. 6, if of course the player had previously landed on the "Anti-Hazard Card" square 19 and received such card. If the player rolls the specific Anti-Hazard FIGS. 9A, 9B, 9C, 9D, 9E, 9F or if the player surrenders an "Anti-Hazard" card FIG. 6, the player may move the player's Vector FIGS. 2A, 26. 2C, 2D, 2E, 2F to the regular playing board at the end of the Hazard Trap 20, 21, 22, 23, 24, 25.

Players must follow the arrows shown with each Hazard Trap 20, 21, 22, 23, 24, 25 to move in the correct direction. Note that players must move in the reverse order in "The Insectory" Hazard Trap 24 If a player surrenders the player's "Anti-Hazard" card FIG. 6 for "The Insectory" Hazard Trap 24 or if the player rolls the specific anti-hazard FIGS. 9A, 9f, 9C, 9D, 9E, 9F, the player moves to the end of "The Insectory" 24 and thus would have to move a few squares backwards on the main playing board path.

One bypass or short-cut exists on the playing board, "The Bridge Over Troubled Water" 18. A player who lands on the square at the entrance to "The Bridge Over Troubled Water" 18 must take the short-cut shown by the arrows. The short-cut however, bypasses the square designated "Anti-Hazard Card" 19.

The playing square immediately before the "FINISH" square 26 is a "Dead End, Ebola" 16. The player is "Cautioned" 15 that a hazard lay ahead. Ebola Virus resides here; there is no corresponding anti-hazard FIG. 9A, 9B, 9C, 9D, 9E, 9F on the "Anti-Hazard" die FIG. 8. The only way to get out of the "Dead End, Ebola" 16 is to surrender an "Anti-Hazard" card FIG. 6, if the player has one,in the player's possession.

The first player to land on or cross the "FINISH" square 26 wins the game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to,falling within the scope of the invention.

what is claimed as being new and desired to be protected by Letters Patent of the United States is as follows:

1. A public health oriented board game system for educating people and promoting awareness as to the nature of infectious diseases, traumatic injuries, chemical threats, and public health issues comprising, in combination:

a square game board, positionable upon a horizontal surface with markings on the upper exposed surface, the game board having fifty-two equally sized squares around the entire periphery to define a path of travel for each player, including one square labeled "START" with arrow pointing in a counterclockwise direction, one square labeled "FINISH," one square labeled "Take a Shortcut" that leads a player to a shortcut over "The Bridge Over Troubled Water," thereby shortening a player's path of travel from one side to an adjacent side and with one square labeled "Anti-Hazard" card, one square with an arrow leading to a "Dead End, Ebola" Hazard Trap, seven "Caution" squares, and six squares labeled "Trapped" with arrows leading a player into one of the Hazard Traps, including "The Hen House," "The Rat Trap," "The Forest Carnivores," "Sea Treasure," "The Insectory," and "Bioterrorism", each of the "Hazard Traps" lengthening a player's path of travel along a single side;

six player tokens, called "Vectors" representing each player's position and path of travel around the game board, including a turtle, pig, fish, dog, fly, and cow;

six hundred playing cards, each card having questions related to infectious diseases, traumatic injuries, chemical threats, and public health issues, and a plurality of potential answers, one of which is correct, the playing cards adapted to be selected randomly by the players whereby a player answers a question correctly to move the player's Vector accordingly in an effort to move the Vector all around the game board;

six "Anti-Hazard" cards, each card awarded to a player who lands on the game board square labeled "Anti-Hazard" card, and can be used by a player upon landing on one of the plurality of squares leading into a Hazard Trap to avoid getting pulled into said Hazard Trap;

two six-sided dice, including a first die with two spots on three sides, three spots on two sides, and four spots on one side, controlling the number of squares which can be advanced by a player when a player answers a question correctly, the second die having drawings of health treatment, prevention, antidote or anti-hazard related objects, including a can of insecticide or bug spray with a dead bug, a frying pan with a hard-cooked egg, a syringe with needle, a gas mask, a chlorine bleach jug, and raw fish over an open flame, controlling whether a player escapes from a plurality of Hazard Traps; and an Information Booklet having board game rules and instructions, background information on infectious diseases, traumatic injuries, chemical threats, and public health issues, and references for each individual question on a playing card.

2. A board game system comprising:

a game board having a plurality of squares around the entire periphery to define a path of travel and further including a shortcut sortened path and a plurality of lengthened paths;

a plurality of tokens representing each player's position on the path of travel around the game board;

a plurality of playing cards, having questions, and a plurality of potential answers, one of which is correct, the playing cards adapted to be selected randomly by the players whereby a player answers a question correctly to move the token accordingly;

a plurality of "Anti-Hazard" cards, awarded to a player who lands on a single designated game board square, which can be used by a player to avoid getting pulled into one of the plurality of lengthened paths; and two dice, including a first die with six sides and a plurality of spots controlling the number of squares which can be advanced by a player when a player answers a question correctly, some of the sides having a common number of spots, the second die having a plurality of drawings, controlling whether a player escapes from a plurality of Hazard Traps, all of the sides having a different drawing.

3. A board game system as in claim 2, further comprising an Information Booklet having a plurality of board game rules and instructions, background information on health-related topics, and references for each individual question on a playing card.

4. A board game system as in claim 2, wherein the game board contains a plurality of markings on the upper exposed surface, including fifty-two equally sized squares that define a player's path of travel, including one square labeled "START" with arrow pointing in counterclockwise direction, one square labeled "FINISH," one square labeled "Take a Shortcut" that leads a player to the shortcut shortened path over "The Bridge Over Troubled Water," thereby shortening a player's path of travel from one side to an adjacent side and with one square labeled "Anti-Hazard" card, one square with an arrow leading to a "Dead End, Ebola" Hazard Trap, seven "Caution" squares, and six squares labeled "Trapped" with arrows leading a player into one of the lengthened paths Hazard Traps, including "The Hen House," "The Rat Trap," "The Forest Carnivores," "Sea Treasure," "The Insectory," and "Bioterrorism", each of the "Hazard Traps" lengthening a player's path of travel along a single side.

5. A board game system as in claim 2, wherein the plurality of tokens include "Vectors," which represent each player's position and path of travel around the game board, including a turtle, pig, fish, dog, fly and cow.

6. A board game system as in claim 2, wherein the plurality of playing cards contain questions related to a plurality of medical, chemical, and public health issues, including infectious diseases, traumatic injuries, and chemical threats, and a plurality of potential answers, one of which is correct, the playing cards adapted to be selected randomly by the players whereby a player answers a question correctly to move the player's Vector accordingly in an effort to move the Vector all around the game board.

7. A board game system as in claim 2, wherein the plurality of cards include "Anti-Hazard" cards, each card awarded to a player who lands on the game board square labeled "Anti-Hazard" card, and can be used by a player upon landing on one of the plurality of squares leading into a Hazard Trap to avoid getting pulled into said Hazard Trap.

8. A board game system as in claim 2, wherein the plurality of dice include a first die with two spots on three sides, three spots on two sides, and four spots on one side, controlling the number of squares which can be advanced by a player when a player answers a question correctly, the second die having drawings of health treatment, prevention, antidote or anti-hazard related objects, including a can of insecticide or bug spray with a dead bug, a frying pan with a hard-cooked egg, a syringe with needle, a gas mask, a chlorine bleach jug, and raw fish over an open flame, controlling whether a player escapes from a plurality of Hazard Traps.

* * * * *